United States Patent [19]

Eissel

[11] 4,214,520

[45] Jul. 29, 1980

[54] PUNCH FOR PUNCHING MARKINGS INTO ROLLED MATERIAL

[75] Inventor: Horst E. Eissel, Solingen, Fed. Rep. of Germany

[73] Assignee: Stommel & Voos Stahlstempelfabrik, Solingen, Fed. Rep. of Germany

[21] Appl. No.: 923,415

[22] Filed: Jul. 10, 1978

[30] Foreign Application Priority Data

Jul. 14, 1977 [DE] Fed. Rep. of Germany ..... 2731849

[51] Int. Cl.[2] ..... B41J 1/38; B41F 17/24

[52] U.S. Cl. ..... 101/4; 101/42

[58] Field of Search ..... 101/3 R, 4, 35–44

[56] References Cited

U.S. PATENT DOCUMENTS

| | | | |
|---|---|---|---|
| 1,162,387 | 11/1915 | Nichols | 101/43 |
| 1,303,042 | 5/1919 | Dowson | 101/37 |
| 1,766,745 | 6/1930 | Griffith | 101/43 |
| 2,641,996 | 6/1953 | Turner | 101/43 |
| 3,120,175 | 2/1964 | Martin | 101/43 |
| 3,310,147 | 3/1967 | Clary | 101/110 |
| 3,765,325 | 10/1973 | Warren | 101/36 |
| 4,104,967 | 8/1978 | Okabe | 101/99 |
| 4,122,770 | 10/1978 | Umeda | 101/99 |

FOREIGN PATENT DOCUMENTS

| | | | |
|---|---|---|---|
| 426728 | 11/1974 | U.S.S.R. | 101/42 |

*Primary Examiner*—Clyde I. Coughenour
*Attorney, Agent, or Firm*—John C. Smith, Jr.

[57] ABSTRACT

A punch for punching markings into rolled material such as bars, ingots, billots or slabs, relative to which the rolled material that is to be punched is guided, comprises a toolholder movable by means of a controlled piston-cylinder arrangement and punch types settable automatically. A punch plate is firmly arranged on a vertical shaft mounted in the toolholder. The drive of this shaft is effected via bevel gears of which one bevel gear supported in an arm of the toolholder is mounted on and driven by a horizontally supported drive shaft driven by means of a step motor and is axially shiftable along the horizontally supported drive shaft with the toolholder. The toolholder together with the cylinder of the piston-cylinder arrangement as well as the step motor is secured to a transverse slide movable transversely of the path of the toolholder.

4 Claims, 4 Drawing Figures

PUNCH FOR PUNCHING MARKINGS INTO ROLLED MATERIAL

BACKGROUND OF THE INVENTION

This invention relates to a punch for punching markings into rolled material such as bars, ingots, billots or slabs, relative to which the rolled material is guided, including a toolholder movable by means of a controlled piston-cylinder arrangement, the punch types being settable automatically.

Such apparatus are known (see for instance U.S. Pat. No. 3,306,186). They are provided with a plurality of punch plates which are rotatably mounted on a common shaft guided in a toolholder. The toolholder is firmly arranged on a slide which is movable by means of a controlled reciprocating cylinder. In such apparatus all punch markings can be produced only simultaneously, i.e. in one operation, in the event the marking to be provided on the rolled material consists of a plurality of letters, figures or other symbols. This brings about the essential disadvantage that in the event of a non-planar end face or cutting surface of the rolled material or in the event of an inclined position of the rolled material in relationship to the punch plates uniform punch markings readily to be discriminated are not insured. An apparatus is already known wherein the slide carrying the toolholder with its slideway as well as the reciprocating cylinder associated with the slide are firmly arranged at the lower side of a support plate horizontally pivotable in counteraction to the lateral pressure of helical springs and wherein at the slideways at the end face two spaced, horizontally arranged rod-shaped feelers projecting beyond the end face of the slideways are positioned which upon engaging the rolled material set the punch plates via the support plate parallel to the surface of the rolled material to be provided with the marking. A proper punch marking is achieved with this apparatus only, however, in the event that the end face of the rolled material is substantially planar. When the end face is non-planar, the punch plates are only able to engage in varying depths in spite of a setting parallel to the end face of the rolled material. A further disadvantage inherent to the conventional apparatus is that the marking regarding the number of individual punch types is dependent on the number of punch plates with which the apparatus is equipped, i.e. for punching for instance a five-digit number five punch plates are required. Furthermore, in the prior art apparatus the spacing of the individual punch markings relative to one another is not variable.

SUMMARY OF THE INVENTION

It is the object of the present invention to avoid these disadvantages and to provide a punch for punching markings into rolled material such as bars, ingots, billots or slabs, which is structurally simplified in such a way that with it unobjectionable punch markings can be produced the spacing of which relative to one another is variable, and that each marking may consist practically of an unlimited number of digits, letters or the like.

To attain this object the present invention provides a punch for punching markings into rolled material such as bars, ingots, billots or slabs, comprising a base; a toolholder arranged for reciprocal movement along a path on said base and including an arm and a pair of relatively spaced side walls; means for moving said toolholder between punching and rest positions at opposite ends of said path; a punch plate having a plurality of punch types and arranged between, and projecting beyond, said side walls; a vertical shaft extending between said side walls and through said punch plate for rotatably supporting said punch plate between said side walls, said punch plate being firmly arranged on said vertical shaft; a step motor mounted on the base for rotating said shaft and thus the punch plate into any desired position; a drive shaft and a pair of bevel gears, said drive shaft operatively connecting the step motor to one of said bevel gears which is supported in the arm of the toolholder and mounted on the drive shaft arranged to be driven by the step motor; a controlled piston-cylinder arrangement mounted on the base for moving the toolholder, said one of the bevel gears being axially shiftable on the drive shaft with the toolholder, whereas the other bevel gear is secured to the vertical shaft carrying the punch plate; a transverse slide carrying the base with the toolholder, the piston-cylinder arrangement and the step motor; means for moving the transverse slide transversely of the path of the toolholder, and means for feeding rolled material to the punch.

Advantageously, a code plate may be firmly arranged on the drive shaft, said code plate having bits for controlling photocells of a scanning device.

Via the code plate the switching off of the step motor and the releasing of the punching operation is initiated at that time at which via the code plate coincidence has been determined between the preselected punch type and the position of the punch plate in which the preselected punch type is precisely in readiness for punching. As a result of the control function of the code plate, thus in a relatively simple way a mispunching is prevented. Via the code plate, furthermore a reduction of the initial high speed operation of the step motor to a creep speed operation is initiated at the time when the punch plate approximates the position in which the preselected punch type is in readiness for punching. This insures that the preselected punch type after a stopping of the punch plate has assumed the position relative to the rolled material required for an unobjectionable punch marking.

Control of the punch according to the invention is exclusively in a known manner from a control desk by means of a microcomputer arranged in a switch box. The types on the punch plate which correspond to the marking for instance consisting of digits, letters or other symbols with which the rolled material is to be marked, are individually pressed into the rolled material in such a way that after each impression of one type and after a renewed positioning of the punch plate it is advanced laterally by one step together with its holder, a further punch marking thereafter being produced. In this way in contradistinction to the conventional apparatus provided with a plurality of punch plates not only are proper punch markings insured, but the marking may also consist of a practically unlimited number for instance of digits. Furthermore, the spacing of the individual punch markings may be varied as a result of the lateral shifting of the toolholder. The punch according to the invention is furthermore greatly simplified in structural aspects over conventional apparatus as a result of the fact that it is equipped with only one punch plate and accordingly only this punch plate has to be positioned.

BRIEF DESCRIPTION OF THE DRAWINGS

An embodiment of the invention will now be described by way of example and with reference to the accompanying drawings, in which:

FIG. 1 shows a punch for punching markings into rolled material such as bars, ingots, billots or slabs, which comprises a toolholder 1 and a punch plate 2. The punch plate 2 is equipped with sixteen punch types and is secured between a pair of relatively spaced side walls of the toolholder 1 to a vertical shaft 3 rotatably mounted in the side walls of the toolholder. The punch plate 2 projects beyond the side walls of the toolholder 1 which is provided as a slide and slides in a flat way 4 of a body 5 which is secured to a base 6. The reference numeral 7 designates the cylinder of a controlled piston-cylinder arrangement the piston rod 8 of which is firmly connected to the toolholder 1. The cylinder 7 is secured to a support arm 9 and to a bracket 10 which in turn are firmly arranged on the base 6. The toolholder 1 has an upwardly directed mounting arm 11 in which a bevel gear 12 is rotatably mounted. The bevel gear 12 meshes with a bevel gear 13 secured to the vertical shaft 3. The reference numeral 14 designates a drive shaft supported in the bracket 10, said bevel gear 12 being secured on said drive shaft 14 such that it is not rotatable relative to the drive shaft 14 but is axially shiftable thereon together with the toolholder 1. The drive shaft 14 is coupled by means of a coupling 15 to the shaft 16 of a step motor 17 which is secured to a bracket 18 which in turn is secured on the base 6. The step motor 17 performs a step angle of 0.9° per pulse. Since the punch plate 2 is equipped with sixteen punch types, a step number of twenty-five results per graduation. On the drive shaft 14, a code plate 19 is firmly mounted with which an optical scanning device 20 is associated. The scanning device 20 is secured to the bracket 10 by means of an arm 21. The code plate 19 is in an operative connection to the step motor 17 of the punch and serves in conjunction with the scanning device 20 the purpose of initiating the switching off of the step motor 17 as well as a releasing of the punching operation, after it has been ascertained by a comparison of the nominal value to the actual value that the preselected punch type is in a position in readiness for punching. Via the code plate 19 furthermore the reduction of the original high speed operation of the step motor 17 to a creep speed operation is initiated. The code plate 19 is provided with six bits 22, 23, 24, 25, 26 and 27 (FIG. 3) consisting of arcuate apertures with which one photocell each of the scanning device 20 is associated. The reference numeral 28 designates a transverse slide on which the base 6 is secured. The transverse slide 28 slides on a flat way 29 of a body 30. The transverse slide 28 is driven by means of a gear motor 31 via a spindle 32 shown in FIG. 2. A limit switch 33 is arranged at the body 30, with which switch operating lobes 34 arranged at the transverse slide 28 are associated.

Figure 1:
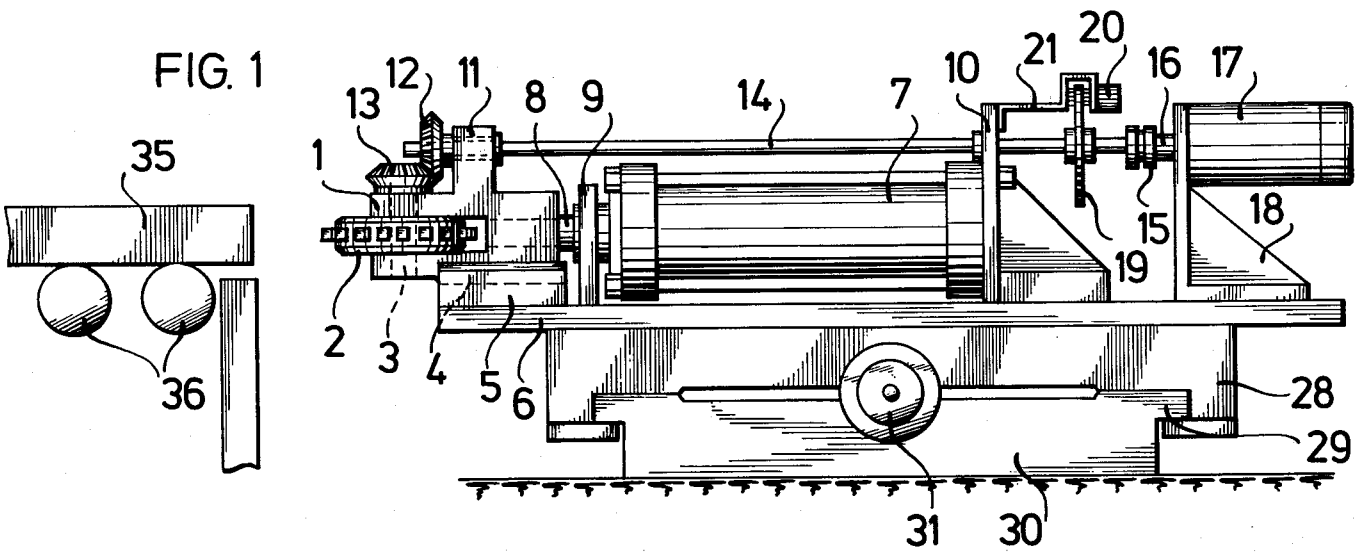
FIG. 1 is a side elevational view of a punch according to the invention.
Figure 2:
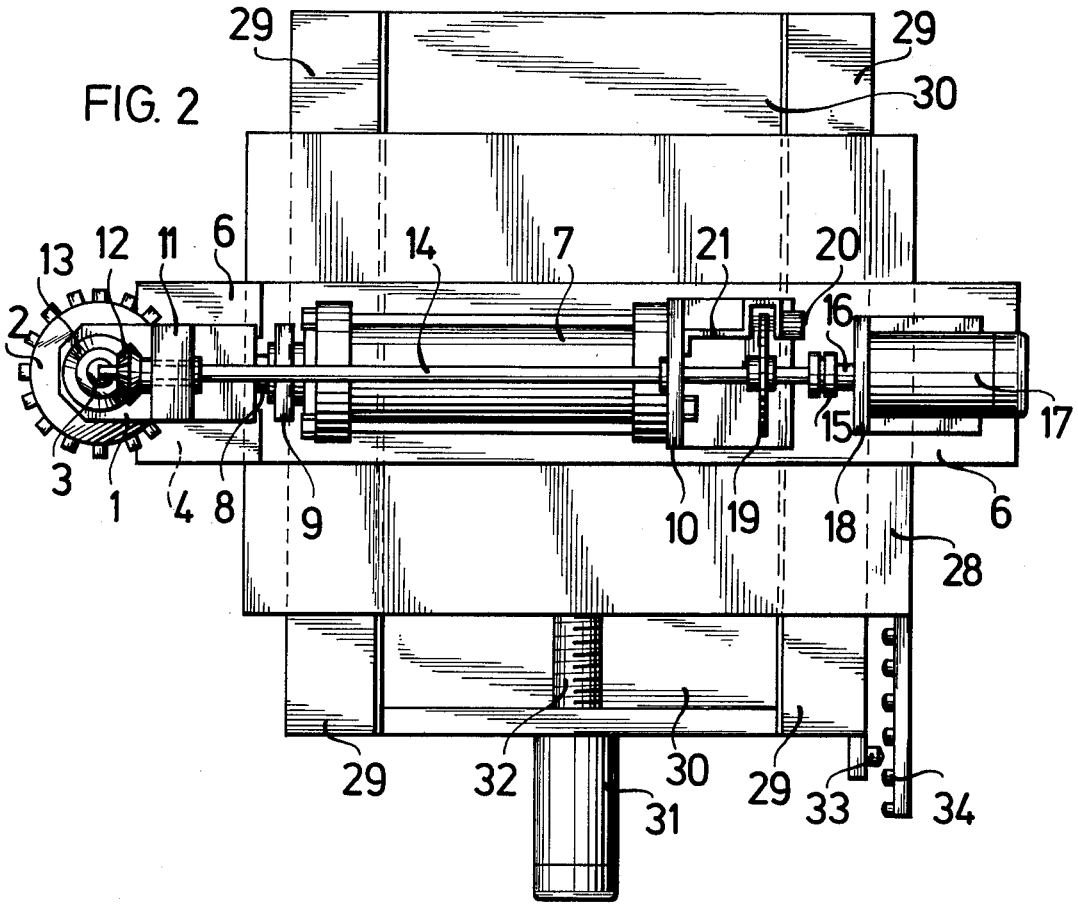
FIG. 2 is a top plan view thereof.
Figure 3:
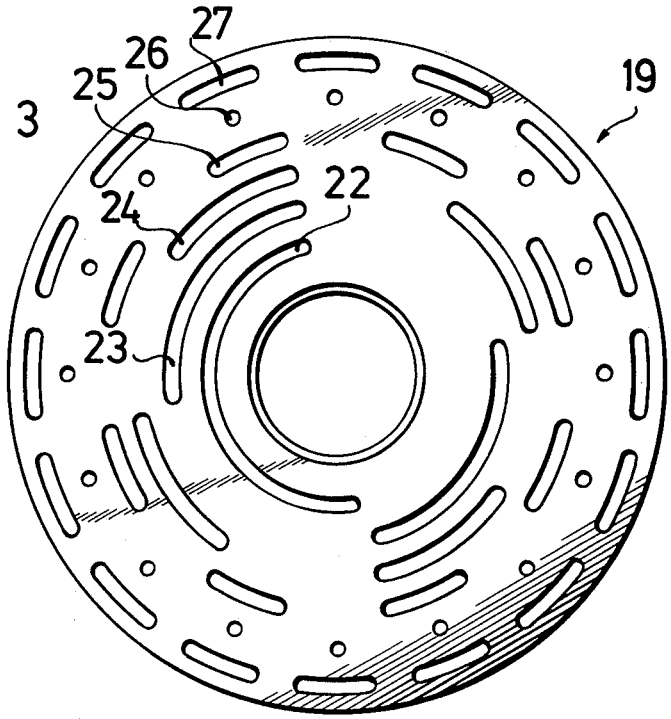
FIG. 3 is an elevational view of the code plate.

The reference numeral 35 in FIG. 1 designates rolled material which is fed to the punch by a roller bed 36.

Figure 4:
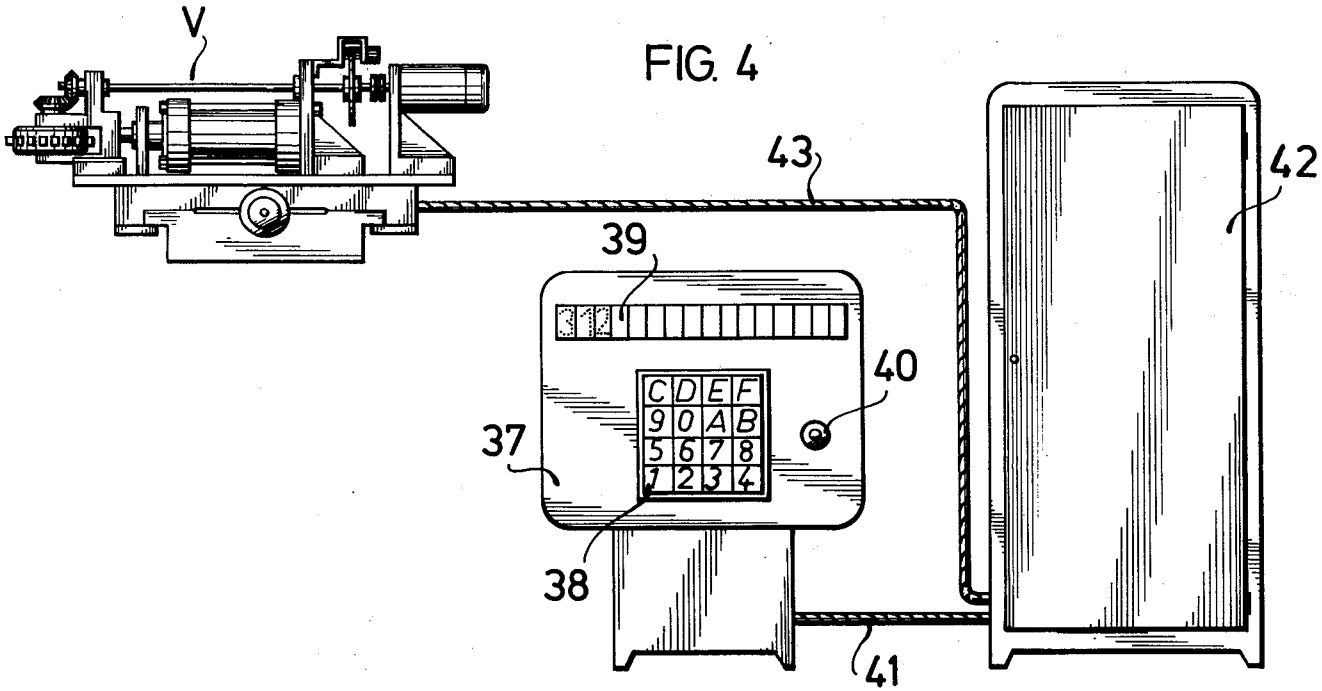
FIG. 4 is a side elevational view of the control desk, switch box and punch.

FIG. 4 shows a control desk 37 which comprises keys 38 for setting the punch types. A pilot lamp 39 is arranged optically to indicate the data fed into the punch by means of the keys 38. The control desk 37 also comprises a push-button 40 by the depression of which the punching operation is initiated. A control cable 41 electrically connects the control desk 37 to a switch box 42. An electrically conductive cable 43 connects the switch box 42 to the punch V.

The operation of the punch is as follows:

The punch types corresponding to the marking with which the rolled material is to be provided are stored in electronic memories of a microcomputer by actuating the corresponding key 38 of the control desk 37. Upon actuating the push-button 40, the step motor 17 receives the switching-in order via the memory logic, and thereby the drive shaft 14 and via the bevel gears 12 and 13 the shaft 3 are driven together with the punch plate 2. Thereby, the associated photocells of the scanning device 20 are controlled by the bits 22, 23, 24 and 25, namely for the purpose of determining via the code plate 19 the coincidence of the preselected punch type with the position in which the preselected punch type is in a position in readiness for punching (comparison between nominal value and actual value). Upon coincidence, by controlling the photocell coacting with the bit 26 via the memory logic the switching off of the step motor 17 is initiated. Furthermore, prior to the switching off of the step motor 17, by the bit 27 the associated photocell is controlled by which a reduction of the original high speed operation of the step motor 17 to creep speed operation is initiated in order to insure in this way that the punch plate 2 moves precisely into that position which is required in order to bring the selected punch type into the proper position in readiness for punching. Upon switching off of the step motor 17, at the same time by pressurizing the reciprocating cylinder 7, the punching operation is released. After punching, the toolholder 1 returns into its starting position again. At the same time, the gear motor 31 receives a pulse whereby the toolholder 1 is advanced laterally by one step by means of the transverse slide 28, the gear motor 31 being switched off again thereafter via the limit switch 33 and an operating lobe 34. Thereafter, the foregoing described procedure is repeated until all punch types corresponding to the marking of the rolled material have consecutively been punched into the rolled material. Thereafter, the transverse slide 28 returns into its starting position again.

The invention may be embodied in other specific forms without departing from the spirit or the essential characteristics thereof. The embodiment is therefore to be considered in all respects as illustrative and not restrictive.

What is claimed is:

1. A punch for punching a succession of different markings into rolled material such as bars, ingots, billots or slabs, comprising (a) a tool holder;

(b) a substantially vertical rotatable drive shaft mounted on said tool holder;

(c) a punch plate mounted on said drive shaft for rotation therewith and having a plurality of punch types thereon;

(d) first support means mounting said tool holder for movement along a substantially horizontal path;

(e) controlled means for reciprocating said tool holder along said substantially horizontal path between punching and rest positions;

(f) rotary stepping drive means on said first support means;

(g) a substantially horizontal rotatable drive shaft extending from said stepping drive means to said tool holder;

(h) a pair of meshing bevel gears, one mounted on said substantially vertical drive shaft and the other mounted on said substantially horizontal drive shaft for rotation therewith and adapted to freely move axially along said horizontal drive shaft with movement of said tool holder along said horizontal path;

(i) second support means mounted on said first support means for movement along a path transverse to said substantially horizontal path of said tool holder;

(j) means for moving said first support means along said transverse path; and (k) control means for operating said means for moving said first support means an incremental distance along said transverse path each time said tool holder returns from said punching position to said rest position;

(l) whereby said punch plate may be rotated by said rotary stepping drive means and advanced laterally by said means for moving said first support means after each punching operation to punch a succession of different markings into said rolled material.

2. A punch as set forth in claim 1 further comprising a code plate mounted on said substantially horizontal drive shaft, said code plate having a plurality of bits arranged in a plurality of coaxial circles, and a plurality of photocells, each arranged to sense the bits in one of said coaxial circles for controlling said stepping drive means and the selection of punch types on said punch plate.

3. A punch as set forth in claim 1 wherein said means for reciprocating said tool holder is a piston-cylinder arrangement.

4. A punch as set forth in claim 1 wherein said control means for operating said means for moving said first support means comprises a limit switch and a plurality of successive switch operating lobes, said limit switch being mounted on one of said first and second support means and said lobes being mounted on the other of said first and second support means and arranged such that each successive switch operating lobe contacts said limit switch during movement of said first support means by a predetermined incremental distance along said transverse path.

* * * * *